US006612881B2

(12) United States Patent
Kanno

(10) Patent No.: US 6,612,881 B2
(45) Date of Patent: Sep. 2, 2003

(54) ENGINE CONTROL ARRANGEMENT FOR WATERCRAFT

(75) Inventor: Isao Kanno, Shizuoka (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 09/922,756

(22) Filed: Aug. 6, 2001

(65) Prior Publication Data

US 2002/0045391 A1 Apr. 18, 2002

(30) Foreign Application Priority Data

Aug. 4, 2000 (JP) ..... 2000-236816

(51) Int. Cl.[7] ..... B63H 21/22

(52) U.S. Cl. ..... 440/1; 440/38; 123/198 DC; 123/198 D; 200/61.52

(58) Field of Search ..... 440/1, 38, 2; 123/198 D, 123/198 DB, 198 DC; 340/689, 984, 985, 986, 987; 180/282, 283; 114/55.5, 55.55, 55.56, 55.57; 200/61.45 R, 61.52

(56) References Cited

U.S. PATENT DOCUMENTS 2,773,953 A * 12/1956 Lawick ..... 200/61.51
3,701,093 A * 10/1972 Pick ..... 200/61.52
3,807,343 A * 4/1974 Peebles ..... 180/273
3,999,178 A * 12/1976 Hamilton ..... 200/52 A
4,743,213 A * 5/1988 Nishida ..... 114/55.56
4,871,996 A * 10/1989 Tsunamoto et al. ..... 114/275
4,917,061 A * 4/1990 Nagakura ..... 123/179.3
4,941,854 A * 7/1990 Takahashi et al. ..... 114/55.57
5,033,428 A * 7/1991 Sasaki ..... 123/198 D
5,144,300 A * 9/1992 Kanno ..... 123/198 DC
5,634,422 A 6/1997 Kobayashi et al.
6,000,355 A 12/1999 Hall
6,419,531 B1 * 7/2002 Nanami et al. ..... 123/198 D

OTHER PUBLICATIONS

Co–pending patent application: Ser. No. 09/595,676, filed Jun. 19, 2000, entitled Vapor System Arrangement for Marine Engine, in the name of Massayoshi Nanami, and assigned to Yamaha Hatsudoki Kabushiki Kaisha.

Co–pending patent application: Ser. No. 09/596,786, filed Jun. 19, 2000, entitled Control System for Small Watercraft, in the name of Nanami, et al. and assigned to Yamaha Hatsudoki Kabushiki Kaisha.

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A watercraft has an overturn detector. The detector communicates with a controller to prevent a false overturn signal. The controller does not act on overturn signals when the watercraft is operating above a preset engine speed associated with planning mode. The controller stops the engine when the overturn signal persists for longer than a predetermined period of time while the engine is operating below the preset engine speed. The controller also monitors the overturn detector for failure. In the event of a failure during engine starting, the engine is allowed to run while the operator is alerted. In the event of a failure during engine operation, the engine is stopped and the operator is alerted if the watercraft is not in planing mode. If the failure during engine operation occurs when the watercraft is in planing mode, the operator is alerted but the engine is not stopped.

20 Claims, 6 Drawing Sheets

ENGINE CONTROL ARRANGEMENT FOR WATERCRAFT

PRIORITY INFORMATION

This application is based on and claims priority to Japanese Patent Application No. 2000-236816, filed Aug. 4, 2000, the entire contents of which is hereby expressly incorporated by reference.

BACKGROUND OF THE INVENTION

1. Field of the Invention

The present application generally relates to an engine control arrangement for controlling a watercraft, and more particularly relates to a method of controlling the operation and interaction of an engine and an overturn switch.

2. Description of the Related Art

Watercraft, including personal watercraft and jet boats, are often powered by at least one internal combustion engine having an output shaft arranged to drive one or more water propulsion devices. Occasionally, watercraft can overturn due to the sporting manner in which they can be ridden. Additionally, some watercraft operators purposely overturn the vehicles or submerge the vehicles during operation.

Watercraft use air ducts to supply air to a generally enclosed engine compartment. The air is drawn from within the engine compartment for combustion. Thus, when a watercraft overturns, there is a danger of water entering the engine compartment and entering into the engine itself through the induction system, which can cause extensive engine damage.

To reduce the likelihood of such engine damage, overturn switches have been used. The overturn switches generally detect watercraft movement that is consistent with a watercraft that is overturning. When such movement is detected, the overturn switch quickly outputs a signal that is used to shut-off the engine. By rapidly shutting of the engine, induction of water into the engine is much less likely during watercraft inversion.

Typical overturn switch designs generally are gravity-biased or centrifugal in nature. When the associated watercraft overturns, the switch's position relative to gravity may cause the switch to detect the overturn or the rapid movement of the switch may cause the switch to detect the overturn. Unfortunately, watercraft are designed for sporting operation and often are operated in manners that cause rapid directional changes. For instance, the watercraft operator may engage in such activities as jumping, rapid turning and operation over rough water. Such activities can cause the typical overturn switches to falsely indicate an overturn leading to an undesirable and unnecessary engine shut off.

Watercraft also generally employ lanyard switches. Lanyard switches generally comprise a wrist tether (i.e., a wristband that is tethered to a "key" or other member that cooperates with a switch). When an operator of the watercraft falls from the watercraft, the wrist tether activates the lanyard switch and the engine is stopped. In effect, the lanyard switch generally operates as a kill switch that stops engine operation when the operator falls from the watercraft.

Over time it also is possible for the overturn switch 12 to experience certain failures due to normal aging and use of the watercraft 10. Generally speaking, the overturn switch 12 may experience two classes of failures: (1) the overturn switch itself or the wiring may become short-circuited, or (2) the connection to the overturn switch may become disconnected.

SUMMARY OF THE INVENTION

If an operator falls from a vehicle during operation of the vehicle in a planing speed range, the lanyard switch almost always will kill engine operation. Additionally, it has been discovered that most false positives from the watercraft overturn switches are encountered during operation at or above a watercraft planing speed (or an engine speed associated with planing, such as about 6000 rpm). The false positives can be irritating to the operator and can adversely affect water vehicle performance.

Thus, a method of reducing false overturn signals is desired. In addition, due to the relatively important role the overturn switch plays, a technique of monitoring the operability of the switch is desired.

Accordingly, an engine control arrangement is desired to properly control the interaction of an overturn switch and an engine in order to prevent unnecessary engine shut off In addition, the engine control arrangement preferably can be configured to warn the watercraft operator of a disconnected, shorted, or faulty overturn switch.

Thus, one aspect of the present invention involves a method of controlling engine operation in a watercraft. The method comprising sensing a engine speed, determining if said engine speed is above a preset engine speed associated with a watercraft planing mode, sensing an overturn signal from an overturn sensor, determining whether said overturn signal persists for longer than a predetermined period of time and stopping the engine when said overturn signal persists for longer than a predetermined period of time.

Another aspect of the present invention involves a personal watercraft comprising a hull. A substantially enclosed compartment is by the hull. An engine is disposed within the compartment and an overturn switch mounted within the compartment. The overturn switch communicates with an ECU through a switch circuit. The overturn switch has a first output, a second output and a third output, with the second output indicating a switch circuit malfunction to the ECU.

BRIEF DESCRIPTION OF THE DRAWINGS

These and other features, aspects and advantages of the present invention are described in detail below with reference to the accompanying drawings. The drawings comprise 6 figures.

DETAILED DESCRIPTION OF THE PREFERRED EMBODIMENT

With reference to FIGS. 1 to 6, an overall configuration of a personal watercraft 10, an overturn switch 12, and various control routines will be described. The watercraft 10 preferably employs an ECU (Electronic Control Unit) 13. The ECU 13, the overturn switch 12, and the disclosed control routines have particular utility for use within the personal watercraft 10, and thus, are described in the context of personal watercraft. The ECU 13, the overturn switch 12, and the control routines, however, also can be used in conjunction with other types of watercraft, such as, for example, small jet boats, and other vehicles that operate on a body of water.

Figure 1:
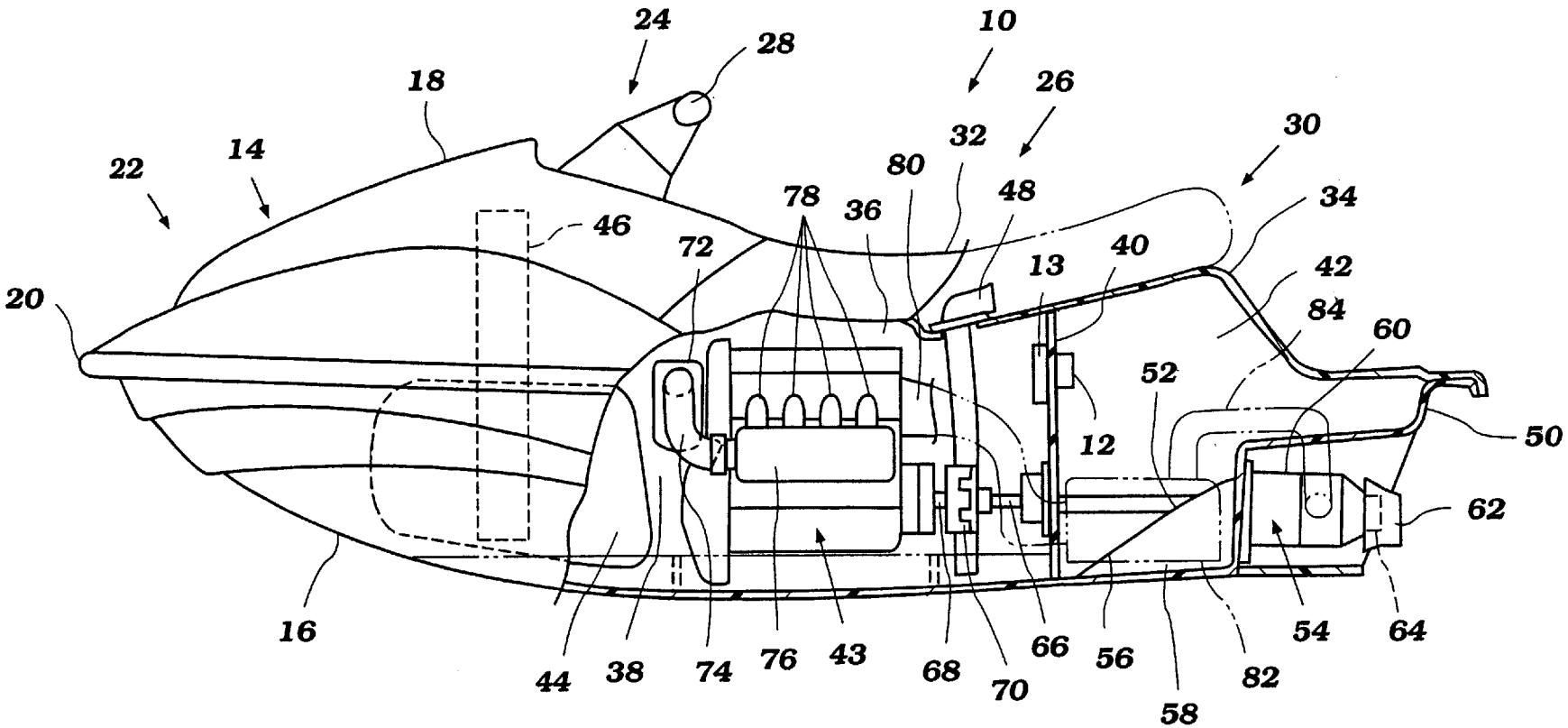
FIG. 1 is a simplified and partially broken out side view of a personal watercraft. Various internal components positioned within the watercraft are illustrated in phantom and hidden lines.

With reference to FIG. 1, the illustrated watercraft 10 includes a hull 14 that is defined by a lower portion 16 and a top portion or deck 18. These portions of the hull 14 are preferably formed from a suitable material, such as, for example, a molded fiberglass reinforced resin. A bond flange 20 preferably connects the lower portion 16 to the deck 18. Of course, any other suitable means may be used to interconnect the lower portion 16 and the deck 18. Alternatively, the lower portion 16 and the deck 18 can be integrally formed.

As viewed in the direction from the bow to the stem, the deck 18 includes a bow portion 22, a control mast 24, and a rider's area 26. The bow portion 22 preferably includes a hatch cover (not shown). The hatch cover preferably is pivotally attached to the deck 18 such that it is capable of being selectively locked in a substantially closed watertight position. A storage bin (not shown) preferably is positioned beneath the hatch cover.

The control mast 24 supports a handlebar assembly 28. The handlebar assembly 28 controls the steering of the watercraft 10 in a conventional manner. The handlebar assembly 28 preferably carries a variety of controls for the watercraft 10, such as, for example, a throttle control (not shown), a start switch (not shown), and a lanyard switch (not shown). Additionally, a gauge assembly (not shown) preferably is mounted to the upper deck section 18 forward of the control mast 24. The gauge assembly can include a variety of gauges, such as, for example, a fuel gauge, a speedometer, an oil pressure gauge, a tachometer, and a battery voltage gauge. In particularly preferred arrangements, a warning lamp or other suitable alerting device can be disposed proximate or within the gauge assembly.

The rider area 26 lies rearward of the control mast 24 and includes a seat assembly 30. The illustrated seat assembly 30 includes at least one seat cushion 32 that is supported by a raised pedestal 34. The raised pedestal 34 forms a portion of the upper deck 18 and has an elongated shape that extends longitudinally substantially along the center of the watercraft 10. The seat cushion 32 can be removably attached to a top surface of the raised pedestal 34 by one or more latching mechanisms (not shown) and, in the illustrated arrangement, covers the entire upper end of the pedestal 34 for rider and passenger comfort.

An engine access opening 36 preferably is defined in the upper surface of the illustrated pedestal 34. The access opening 36 opens into an engine compartment 38 formed within the hull 14. The seat cushion 32 can be disposed on a support plate that normally covers and substantially seals the access opening 36 to reduce the likelihood that water will enter the engine compartment 38. When the seat cushion 32 and the associated support plate are removed, the engine compartment 38 is accessible through the access opening 36.

The interior of the hull 14 includes one or more bulkheads 40 that can be used to reinforce the hull 14 internally and that also can serve to define, in part, the engine compartment 38 and a propulsion compartment 42. The propulsion compartment 42 is arranged generally rearward from the engine compartment 38. An engine 43 is mounted within the engine compartment 38 in any suitable manner preferably at a central transverse position of the watercraft 10. A fuel tank 44 preferably is arranged in front of the engine 43 and is suitably secured to the hull 14 of the watercraft 10. A fuel filler tube (not shown) preferably extends between the fuel tank 44 and the upper deck 18.

A forward air duct 46 extends through the upper deck portion 18. The forward air duct 46 allows atmospheric air to enter and exit the engine compartment 38. Similarly, a rear air duct 48 extends through an upper surface of the seat pedestal 34, preferably beneath the seat cushion 32, thus also allowing atmospheric air to enter and exit the engine compartment 38. Air may pass through the air ducts 46, 48 in both directions (i.e., into and out of the engine compartment 38). Except for the air ducts 46, 48, the engine compartment 38 is substantially sealed so as to enclose the engine 43 of the watercraft 10 from the body of water in which the watercraft 10 is operated.

Toward a transom 50 of the watercraft 10, the inclined sections of the lower hull section 16 extend outwardly from a recessed channel or tunnel 52. The tunnel 52 is recessed within the lower hull section 16 in a direction that extends upward toward the upper deck section 18. An intake duct 56, defined by the hull tunnel 52, begins at an inlet 58 and extends to a jet pump unit 54 which propels the watercraft 10.

The jet pump unit 54 comprises an impeller housing 60. A steering nozzle 62 is supported at the downstream end of a discharge nozzle 64 of the impeller housing 60 by a pair of vertically extending pivot pins (not shown). In an exemplary embodiment, the steering nozzle 62 has an integral lever on one side that is coupled to the handlebar assembly 28 through, for example, a bowden-wire actuator, as known in the art. In this manner, the operator of the watercraft 10 can move the steering nozzle 62 to effect directional changes of the watercraft 10.

An impeller shaft 66 supports an impeller (not shown) within the impeller housing 60. The aft end of the impeller shaft 66 is suitably supported and journaled within a compression chamber of the impeller housing 60 in a known manner. The impeller shaft 66 extends in a forward direction through the bulkhead 40. A protective casing preferably surrounds a portion of the impeller shaft 66. The forward end of the impeller shaft is connected to a crankshaft 68 of the engine 43 via a toothed coupling 70 in the illustrated arrangement.

With continued reference to FIG. 1, an engine air intake system is illustrated. A portion of the air entering the watercraft 10 through the air ducts 46, 48 enters the engine 43 through an intake silencer 72, which is positioned generally in front of the illustrated engine 43. The air travels from the silencer 52 through an intake duct 74 and into an intake chamber 76. The air enters the engine 43 from the intake chamber 76 directly through various intake pipes 78 which extend upward from the intake chamber 76 and inward toward the engine 43.

With reference to FIG. 1, an exhaust system is illustrated. The exhaust gases leaving the engine 43 travel into an initial exhaust pipe 80, through a water trap 82, through a secondary exhaust pipe 84 and exit the watercraft proximate the jet pump unit 54. The engine 43, which drives the jet pump unit 54, can be a four-stroke in-line straight four cylinder engine. However, it should be appreciated that several features and advantages of the present invention can be used with an engine with a different cylinder configuration (e.g., v-type, w-type or opposed), a different number of cylinders (e.g., six) and/or a different principle of operation (e.g., two-cycle, rotary, or diesel principles).

The watercraft 10 preferably includes an emergency stop system 86 that determines when the watercraft 10 is overturned and monitors the overturn switch 12 to inform the rider if the overturn switch 12 is faulty. The emergency stop system 86 in the illustrated arrangement includes the overturn switch 12 (see FIG. 2) and the ECU 13 (see also FIG. 1). The emergency stop system 86 is illustrated schematically in FIG. 3 where the overturn switch 12, an engine speed sensor 87, and a lanyard engine stop switch 88 are inputs to the ECU 13. The output signal from the ECU 13 is directed to the spark plug 96 and/or fuel injector system 94. Preferably, the ECU 13 can cease engine operation by interrupting either ignition or fuel injection (e.g., if an exhaust catalyst is employed, fuel injection preferably is stopped) under appropriate conditions, which will be understood from the following discussion.

Figure 2:
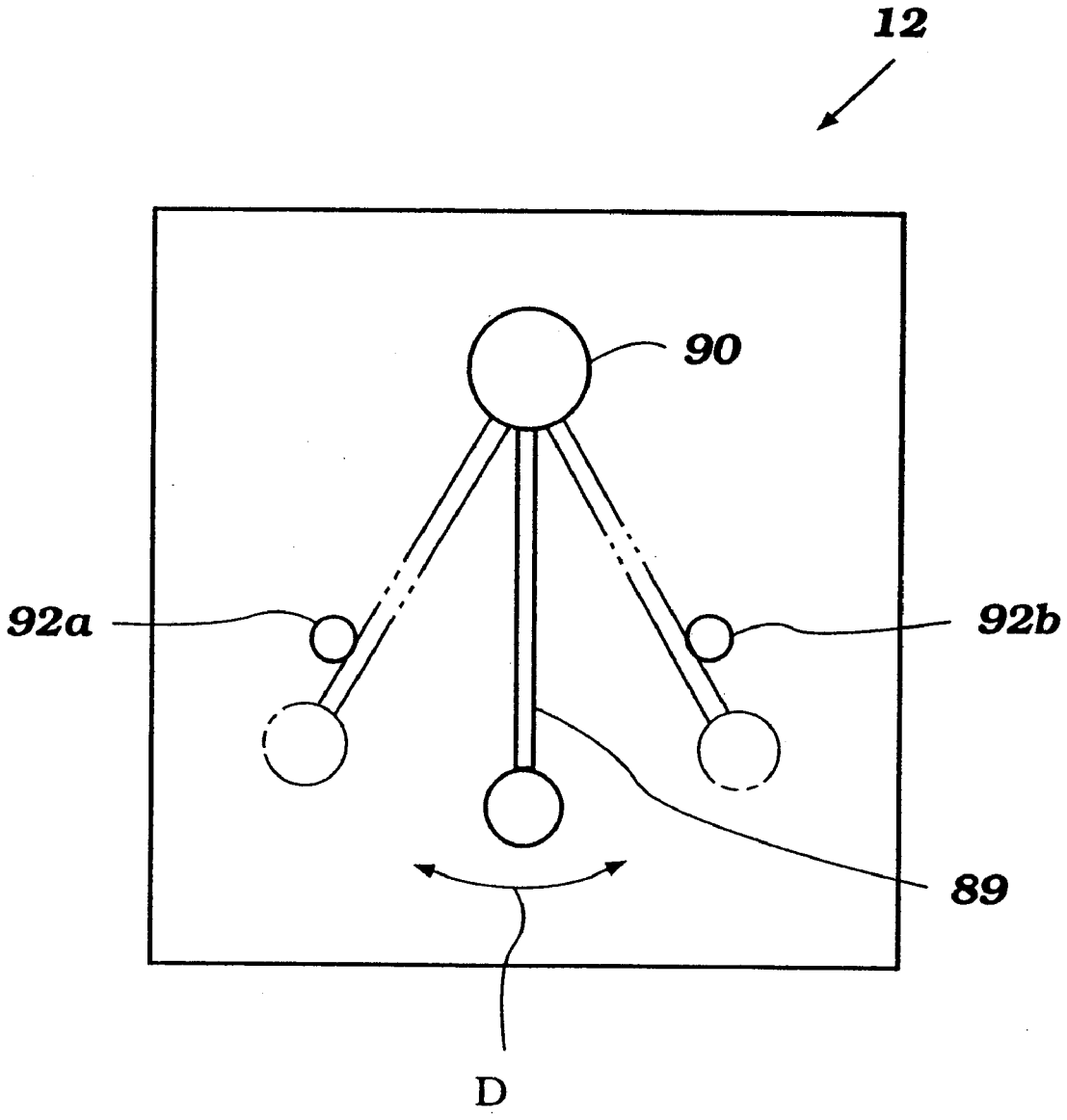
FIG. 2 is a simplified schematic illustration of an exemplary overturn switch.
Figure 3:
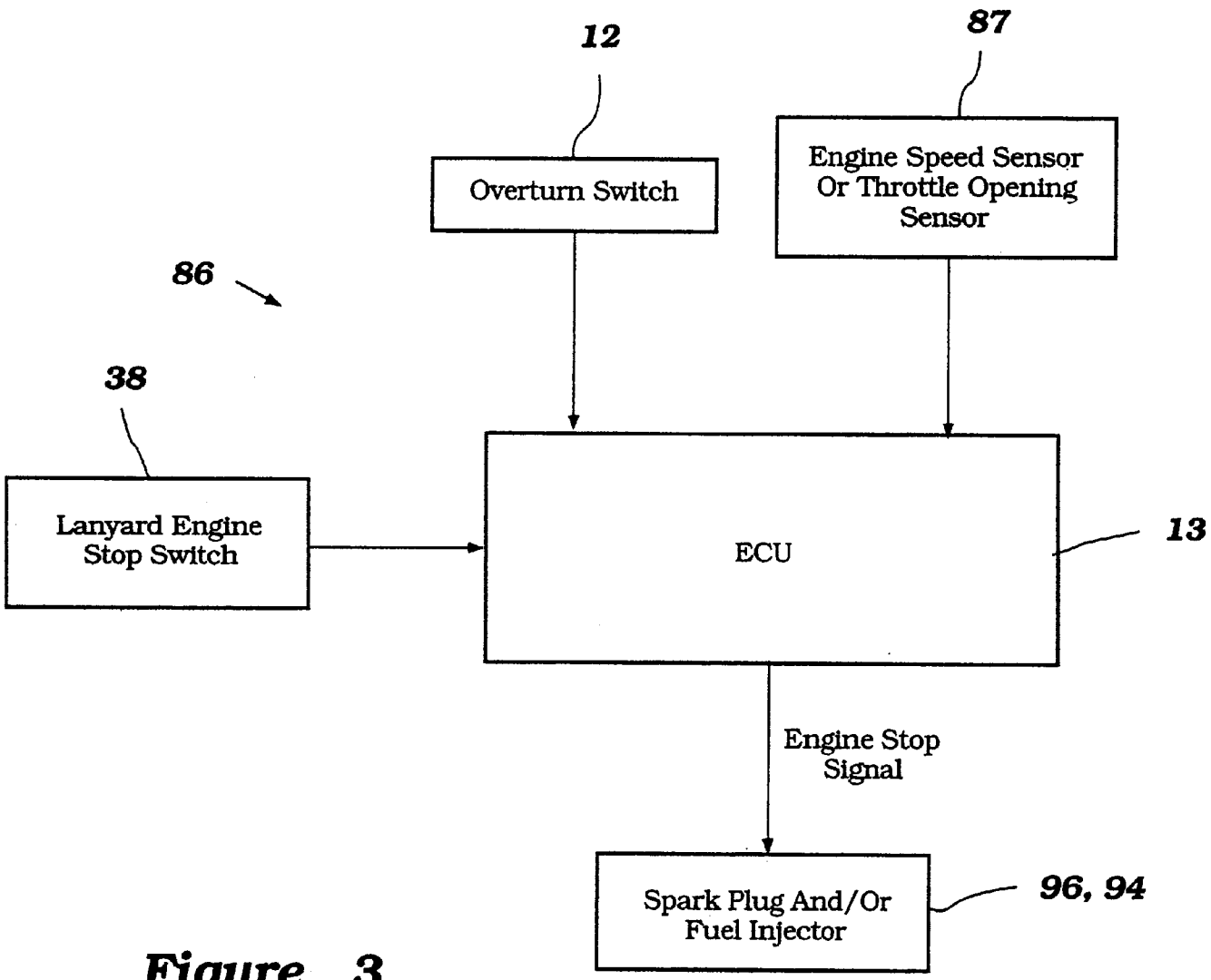
FIG. 3 is a block diagram showing various inputs and outputs of an ECU (Electronic Control Unit) that can be used in accordance with certain features, aspects, and advantages of the present invention.

FIG. 2 illustrates an arrangement of the overturn switch 12. It should be noted that the overturn switch could be mounted in any of a number of positions in and on the watercraft. The overturn switch 12 can include a pendulum 89 that is configured to pivot about an axis 90. When the watercraft 10 is overturned, the pendulum 89 pivots, as indicated by the arrow D, and rests against the right or left stopper 92*a*, 92*b*. When the pendulum 89 contacts one of the stoppers 92*a*, 92*b*, the overturn switch 12 sends a signal to the ECU 13. While one particular switch is illustrated in FIG. 2, any suitable overturn switch can be used.

Figure 4:
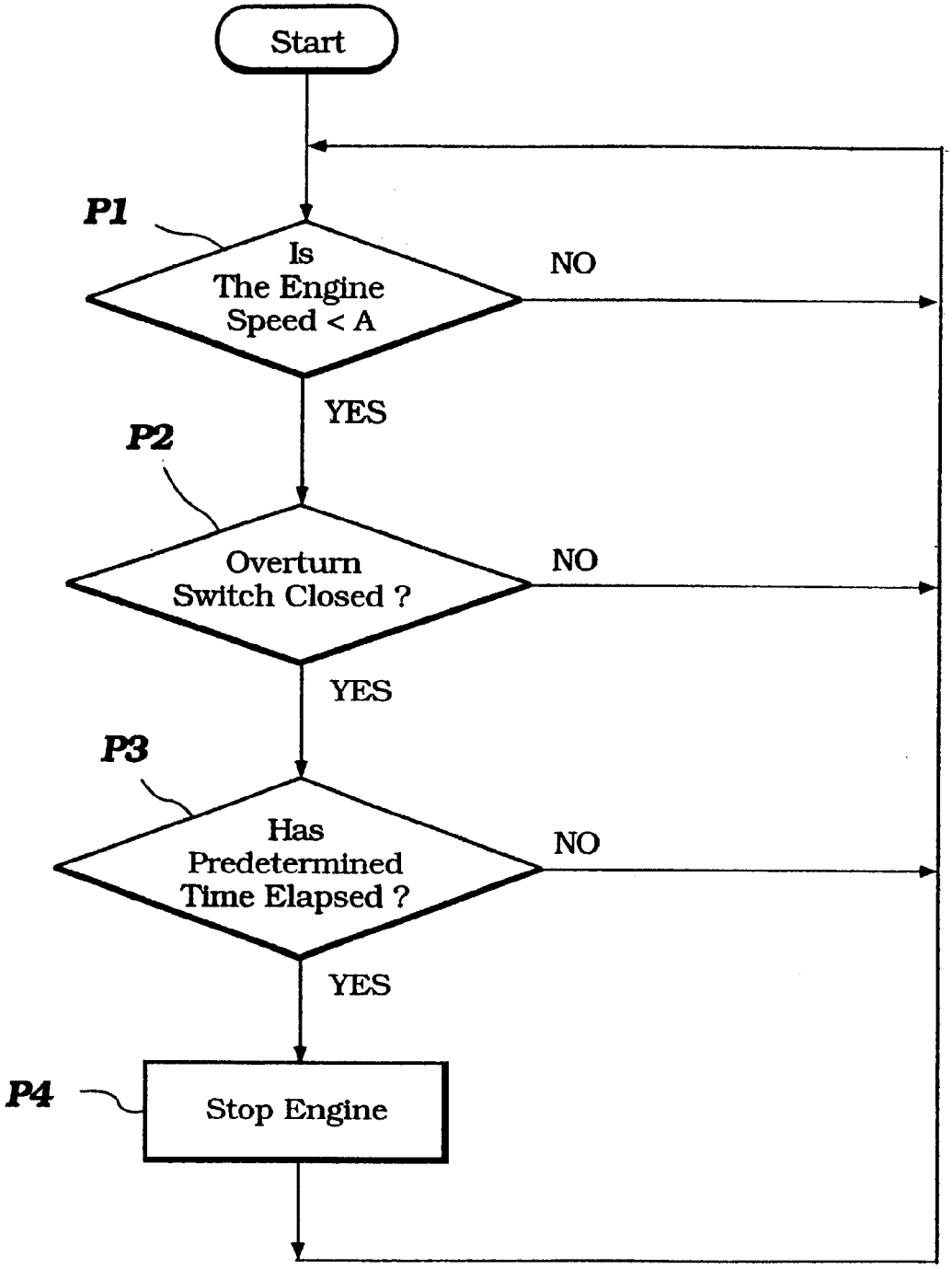
FIG. 4 is a flowchart showing an exemplary control routine arranged and configured in accordance with certain features, aspects, and advantages of the present invention.

With reference to FIG. 4, a control arrangement is shown that is arranged and configured in accordance with certain features, aspects, and advantages of the present invention. The routine basically evaluates whether a false overturn signal is likely and provides an appropriate sensing technique to substantially reduce the likelihood of false overturn signals.

The illustrated control routine begins and moves to a first decision block P1 in which the engine speed is compared to a predetermined engine planing speed "A" (e.g., A can be about 6000 RPM in some applications). Preferably, the predetermined engine planing speed is an engine speed that generally corresponds to a watercraft speed that places the watercraft 10 in the planing mode. Such a speed generally identifies that the watercraft is being operated at a water speed that greatly increases the likelihood of a false positive overturn signal. Additionally, operation at or above that speed generally results in operation of a lanyard activated kill switch when the watercraft overturns.

If the watercraft 10 is found to be in a planing mode, then the watercraft 10 is operating in a vehicle speed range in which the overturn switch 12 may be closed temporarily due to jumping or rough waters, for instance. Therefore if the engine speed is determined to be greater than "A", the routine returns to start and repeats. If the engine speed is less than "A", the routine proceeds to a decision block P2 where it determines if the overturn switch 12 is closed.

In the decision block P2, if the overturn switch 12 is determined to be closed, then the routine proceeds to a decision block P3 where the routine checks whether a preset period of time, which can be determined empirically, has passed. Preferably, the time period is long enough to distinguish a false positive signal caused by jumping or the like and the time period is short enough to greatly reduce the likelihood of substantial water ingestion by the engine in the event of an actual overturn. In some applications, the time period can be about 0.5 second. If the predetermined period of time has passed, then the watercraft 10 most likely has overturned and the routine would move to process block P4. In the process block P4, the engine 43 is shut off and the routine then repeats.

As illustrated, if, in the decision block P2, the overturn switch 12 is open, then the routine repeats. In the decision block P3, if a predetermined amount of time has not elapsed, then the routine repeats without stopping the engine 43.

In short, when the ECU 13 receives a signal from the overturn switch 12 while the watercraft is operating in a nonplaning mode, a delay loop is employed for a predetermined amount of time. If the overturn switch 12 is still sending a signal to the ECU 13 after the predetermined amount of time, the emergency shut off system 86 determines that the watercraft 10 has overturned. If the overturn switch 12 has stopped sending a signal after the predetermined amount of time, the emergency shut off system 86 determines that the watercraft has not overturned. In such a situation, the ECU 13 continues to look for a signal from the overturn switch 12 while normal engine operation continues. If the emergency shut off system 86 determines that the watercraft 10 is overturned, the ECU 13 stops the engine 43 by stopping the supply of electricity to the ignition system or by stopping the fuel supply through the fuel injectors.

An advantage of this arrangement is that the emergency shut off system 86 does not determine that the watercraft 10 is overturned if the watercraft 10 is merely turning abruptly or rocking back and forth quickly. In such situations, the pendulum 88 contacts the stoppers 92*a*, 92*b* for period of time that is less than the predetermined time. Unless the pendulum 88 rests on one of the stoppers 92*a*, 92*b* for the predetermined period of time (e.g., about 0.5 second), no overturn is detected and engine operation is uninterrupted. Additionally, when the vehicle is being operated at planning speeds, the lanyard switch can be used to shut down the engine during a vehicle overturn such that the output from the overturn switch can be ignored. This technique greatly reduces the likelihood of false positive signals from the watercraft during operation.

Figure 5:
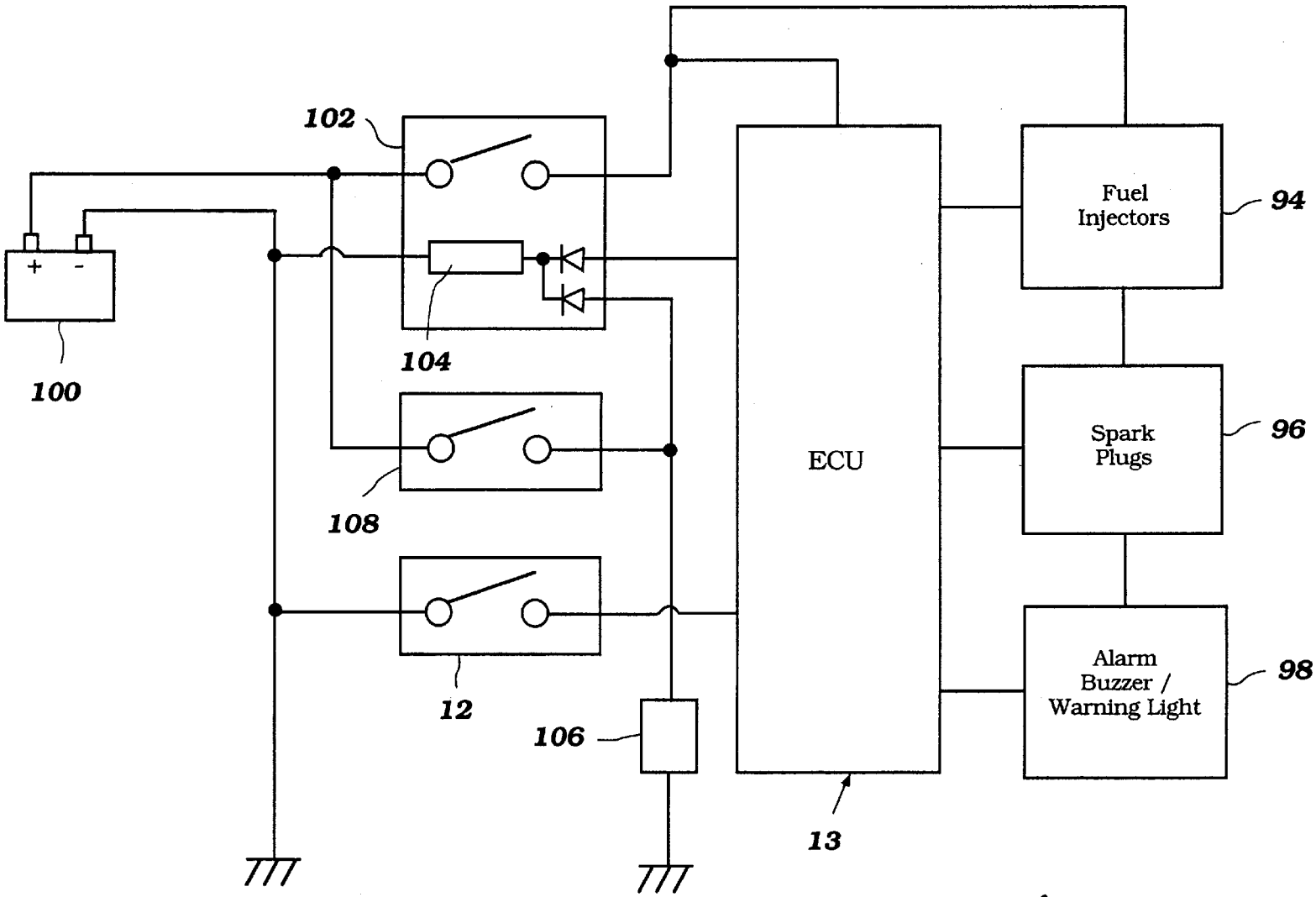
FIG. 5 is an exemplary schematic circuit diagram, including the ECU and the overturn switch, which are arranged and configured in accordance with certain features, aspects, and advantages of the present invention.
Figure 6:
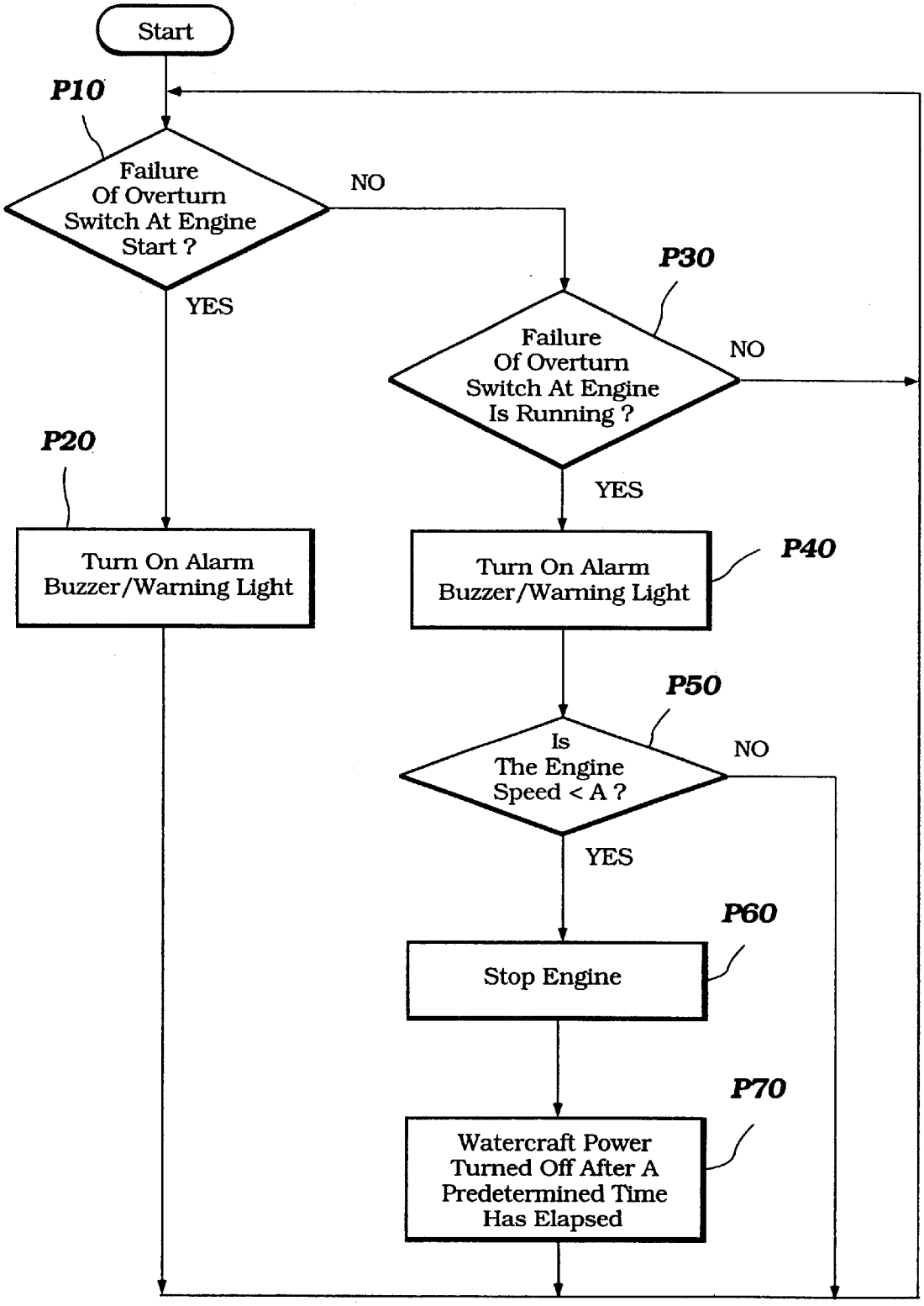
FIG. 6 is a flowchart showing another control routine arranged and configured in accordance with certain features, aspects and advantages of the present invention.

In order to provide a system for better determining if the watercraft 10 is capsized using the overturn switch 12, the system desirably is capable of checking the operability of the overturn switch 12. With reference to FIGS. 5 and 6, a schematic of a control circuit and a control routine are shown. The ECU 13 preferably controls various outputs; (e.g., fuel injectors 94, spark plugs 96, and the alarm 98), in order to turn off the engine 43 in the case of an overturn, or to communicate with the driver that the overturn switch 12 is faulty.

With reference to FIG. 5, power is provided from a battery 100 to the ECU 13, the fuel injectors 94, spark plugs 96, and the alarm 98 through a main relay 102. A main relay circuit 104 controls shutting off the main relay operation during capsizing. In the illustrated arrangement, a signal from the ECU 13 is sent when the predetermined time needed to determine a watercraft overturn has elapsed, as discussed above. A starter relay 106 switches on as soon as the starter switch 108 is closed and keeps the main relay 102 closed (i.e., on) after the starter switch 108 is opened and the starter (not shown) stops operating (i.e., the engine operates under its own power rather than under the starter's power).

With reference now to FIG. 6, an overturn switch failure control arrangement that is arranged and configured in accordance with certain features, aspects, and advantages of the present invention is illustrated. The control routine begins and moves to a first decision block P10 in which operability of the overturn switch 12 at engine start is checked.

In a presently preferred arrangement, the operability can be monitored by detecting the voltages of the overturn switch 12. In one advantageous arrangement, the voltages of the overturn switch 12 are prearranged to be about 0 volts when the overturn switch 12 is closed (e.g., when the watercraft is capsized) and about 5 volts (or about 12 volts in some applications) when the overturn switch is open. When the wires are disconnected from the overturn switch 12, the voltage can default to about 2.5 volts (or about 6 volts in some applications). Any suitable wiring arrangement can be used to create these or similar voltage levels under the above-described conditions. Thus, these various voltage levels can be used to determine a failure of the overturn switch 12. It should be noted that other voltage levels also can be used, however, for reasons that are apparent, the use of a zero voltage, a high level voltage, and a mid level voltage have been selected.

If there is a failure of the overturn switch 12 at engine start, then the control routine moves the decision block P20 where the alarm buzzer/warning light 98 is switched on. The alarm buzzer/warning light can be disposed proximate the control mast 24. When the alarm 98 is switched on, a software alarm flag can be set in the ECU 13. The flag can be used by the software to indicate an on-going error in the system. Thus, in the illustrated arrangement, the alarm 98 remains on until the switch has been repaired and the alarm flag in the ECU 13 is reset (e.g., by a repair technician). Other suitable techniques of indicating a failure also can be used.

If there is no failure at engine start (i.e., at decision block P10), the control routine proceeds to decision block P30 where operability is checked during engine operation. If no failure occurs while the engine 43 is running, then the control routine simply continues to repeat.

If a failure does occur while the engine 43 is running, the control routine proceeds to the operation block P40 and turns on the alarm 98 (where again an alarm flag can be set in the ECU 13).

The control routine then proceeds to the decision block P50 where the engine speed is compared to a predetermined engine planing speed "A" (e.g., A can be about 6000 RPM in some applications). Preferably, the predetermined engine planing speed is an engine speed that generally corresponds to a watercraft speed that places the watercraft 10 in the planing mode. If the watercraft 10 is found to be in a planing mode then operability of the overturn switch is considered less important for the reasons discussed above. The engine 43 preferably is not shut off if the watercraft 10 is above the planing speed even if the overturn switch 12 is closed or faulty. Therefore, if the engine speed is determined to be greater than "A", the routine returns to start and repeats.

It should be noted that a throttle position sensor can be used, in some arrangements, to act as a proxy for engine speed sensing. For instance, a throttle position of 30 degrees may be determined to be an approximate throttle position at which the watercraft can reach planing speed. In such cases, the approximate throttle position can be checked rather than engine speed, if desired. Furthermore, the engine speed actually serves as a proxy for watercraft speed or watercraft operational mode (i.e., planing mode). Therefore, in some arrangements, a watercraft speed sensor, planing condition sensor, or any other suitable sensor arrangement for determining a planing speed or watercraft operational mode can be used.

If the engine speed is less than "A", (e.g., the watercraft is decelerated), the routine proceeds to an operation block P60 where the engine 43 is stopped. The control routine then proceeds to the operation block P70 where power to the entire watercraft 10 is shut down after a predetermined time has passed. The control routine then returns to start and repeats upon the next starting of the engine. Upon the next starting of the engine, if the malfunction of the overturn switch continues to be detected, the routine simply activates the buzzer and allows the watercraft to operate (i.e., the engine is not shut down). In one preferred arrangement, at least one cylinder is disabled such that the watercraft speed is limited and the watercraft can return to port under a "limp-home" mode.

It is to be noted that the control systems described above may be in the form of a hard-wired feedback control circuit in some configurations. Alternatively, the control systems may be constructed of a dedicated processor and memory for storing a computer program configured to perform the steps described above in the context of the flowcharts. Additionally, the control systems may be constructed of a general purpose computer having a general purpose processor and memory for storing the computer program for performing the routines. Preferably, however, the control systems are incorporated into the ECU 13, in any of the above-mentioned forms.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, various steps within the routines may be combined, separated, or reordered. In some arrangements, both routines described above are integrated and implemented in a single application. In addition, some of the indicators sensed (e.g., engine speed and throttle position) to determine certain operating conditions (e.g., watercraft planing speed) can be replaced by other indicators of the same or similar operating conditions. Moreover, not all of the features, aspects and advantages are necessarily required to practice the present invention. Accordingly, the scope of the present invention is intended to be defined only by the claims that follow.

What is claimed is:

1. A method of controlling engine operation in a watercraft, the method comprising sensing an engine speed, determining if said engine speed is above a preset engine speed associated with a watercraft planing mode, sensing an overturn signal from an overturn sensor, determining whether said overturn signal persists for longer than a predetermined period of time and stopping the engine when said overturn signal persists for longer than a predetermined period of time while the engine is operating below the preset engine speed.

2. The method of claim 1, wherein an engine speed sensor outputs a signal indicative of engine speed.

3. The method of claim 2, wherein said preset engine speed associated with said watercraft planing mode is about 6000 rpm.

4. The method of claim 1, wherein said predetermined period of time is about 0.5 seconds.

5. The method of claim 1 further comprising sensing operability of said overturn sensor.

6. The method of claim 5, wherein said overturn sensor has a first output level, a second output level and a third output level and said second output level indicates a failure of said overturn sensor.

7. The method of claim 6, wherein said first output level is about zero volts, said second output level is about 2.5 volts and said third output level is about five volts.

8. The method of claim 6, wherein said second output level is about half of the difference between the first output level and the second output level.

9. The method of claim 5 further comprising stopping the engine if said overturn sensor is inoperable and if said sensed engine speed is less than said preset engine speed associated with said watercraft planing mode.

10. The method of claim 5 further comprising alerting an operator of the watercraft if said overturn sensor is inoperable.

11. The method of claim 10 further comprising stopping the engine when said overturn sensor is inoperable only if said sensed engine speed is lower than said preset engine speed associated with said watercraft planing mode.

12. The method of claim 11, further comprising turning off electrical power a second predetermined period of time after the engine is stopped.

13. The method of claim 5, wherein the engine is not stopped if said overturn switch is inoperable upon an engine start.

14. The method of claim 13 further comprising alerting an operator of the watercraft if said overturn switch is inoperable upon the engine start.

15. The method of claim 1 further comprising shutting down said engine if a lanyard is removed from an engine stop switch.

16. A personal watercraft comprising a hull, a substantially enclosed compartment defined by said hull, an engine disposed within said compartment, an overturn switch mounted within said compartment, said overturn switch communicating with an ECU through a switch circuit, said overturn switch having a first output, a second output and a third output, said second output indicating a switch circuit malfunction to said ECU.

17. The watercraft of claim 16 further comprising a speed sensor communicating with said ECU and said ECU being adapted to stop engine operation if output from said speed sensor is lower than a predetermined speed and output from said overturn switch indicates a switch circuit malfunction.

18. The watercraft of claim 17 further comprising an operator alert device and said ECU being adapted to activate said operator alert device if output from said overturn switch indicates a switch circuit malfunction.

19. The watercraft of claim 18, wherein said ECU is further adapted to stop engine operation if said first output is received from said overturn switch for more than a predetermined period of time.

20. The watercraft of claim 16 further comprising an engine stop switch and an associated lanyard switch, said engine stop switch being adapted to shut down said engine when said lanyard is pulled from said engine stop switch.

* * * * *